US005769152A

United States Patent [19]

Yamada

[11] Patent Number: 5,769,152

[45] Date of Patent: Jun. 23, 1998

[54] CONTINUOUS CASTING PROCESS AND CONTINUOUS CASTING/ROLLING PROCESS FOR STEEL

[76] Inventor: Katsuhiko Yamada, 2-6, Fujiwaradaikitamachi 3-chome, Kita-ku, Kobe-shi, Hyogo 651-13, Japan

[21] Appl. No.: 348,927

[22] Filed: Nov. 25, 1994

[30] Foreign Application Priority Data

Nov. 25, 1993 [JP] Japan ..... 5-321096

[51] Int. Cl.[6] ..... B22D 11/12

[52] U.S. Cl. ..... 164/476; 164/484

[58] Field of Search ..... 164/476, 459, 164/484

[56] References Cited

U.S. PATENT DOCUMENTS 4,073,333 2/1978 Korshanov et al. ..... 164/476

FOREIGN PATENT DOCUMENTS 57-97843 6/1982 Japan .
57-106455 7/1982 Japan .
63-16834 1/1988 Japan .
5-15957 1/1993 Japan .
2 014 071 8/1979 United Kingdom .

OTHER PUBLICATIONS

Patent Abstracts of Japan, vol. 6, No. 190 (N–159) (1068), Sep. 29, 1982 and Database WPI, Derwent Publications, AN–82–62235E, JP–57–097843, Jun. 17, 1982.

Patent Abstracts of Japan, vol. 6, No. 199 (M–162), Oct. 8, 1992, JP–57–106455, Jul. 2, 1982.

Patent Abstracts of Japan, vol. 8, No. 140 (M–305), Jun. 29, 1984 and Database WPI, Derwent Publications, AN–84–092170, JP–59–039451, Mar. 3, 1984.

Patent Abstracts of Japan, vol. 12, No. 121 (M–686), Apr. 15, 1988 and Database WPI, Derwent Publications, AN–87–345027, JP–62–248546, Oct. 29, 1987.

Uday Sinha, et al., "Southwire Continuous Rod Process: Innovations for Quality Improvements", Wire Journal International, Jun. 1993, pp. 66–70.

Wolfgang Rodhe, "The CSP (Compact trip Production) Casting and rolling Technology", SEAISI Quarterly, Jan. 1990, pp. 38–47.

H.E. Wiemer, et al., "Mannesmann Demag Thin Slab Casting Concepts for Hot Strip and Heavy Plate Production", SEAISI Quarterly, Jan. 1990, pp. 23–31.

*Primary Examiner*—Joseph J. Hail, III
*Assistant Examiner*—Randolph S. Herrick
*Attorney, Agent, or Firm*—Oblon, Spivak, McClelland, Maier & Neustadt, P.C.

[57] ABSTRACT

In a continuous casting process for steel, a molten core inside a strand is stalled at a specific point Q in a pass line of the strand to form a cored portion including no molten steel in the strand downstream of the specific point Q, and the cored portion is rolled by a pair of rolls under pressing into a solid strand in the latter half of a strand drawing stroke. The resulting solid strand comprises a skin formed of a chill crystal and the interior formed of a columnar crystal by addition of proper casting temperature. A through continuous casting/rolling process in which the above improved continuous casting process is combined with a subsequent hot rolling process is also disclosed. A drastic increase in the casting efficiency, an improvement in quality, and an equipment capable of freely adjusting a casting thickness can be resulted so that direct coupling between continuous casting and rolling is achieved and near-net-shaping of various steel materials is promoted.

6 Claims, 6 Drawing Sheets

FIG. 4a
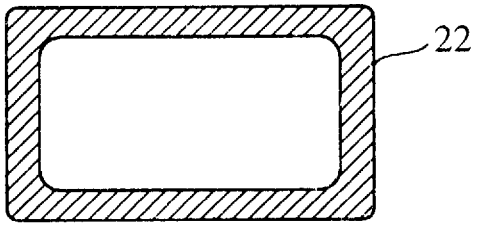
FIG. 4b
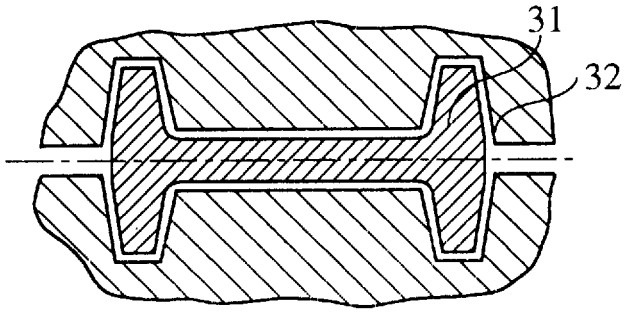
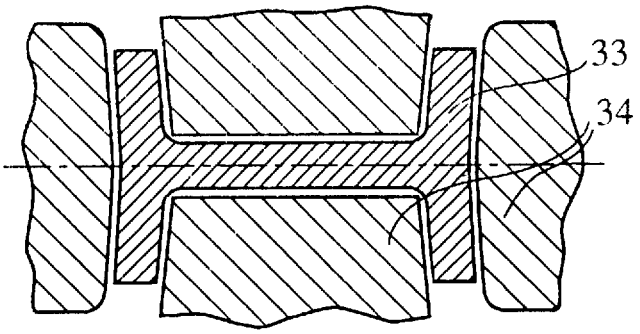
FIG. 4c

CONTINUOUS CASTING PROCESS AND CONTINUOUS CASTING/ROLLING PROCESS FOR STEEL

BACKGROUND OF THE INVENTION

The present invention relates to a continuous casting process for steel, and a process of carrying out continuous casting and hot rolling of steel in a combined manner. More particularly, the present invention relates to development of a continuous casting process which can drastically increase casting efficiency and can improve quality of strands, and a combination of the continuous casting process with hot rolling to provide a continuous casting/rolling process which can successively produce hot-rolled steel from continuous casting in a through process.

With a view of tremendously reducing the production cost of hot-rolled steel, a method of directly coupling a continuous casting (hereinafter referred to as c.c.) line and a hot rolling line is proposed on the one side, and a method of modifying the c.c. process, which is originally regarded to be closer to the near-net-shaping process than the ingot making, so as to become even closer to near-net-shaping is researched on the other side.

Both the above methods are not contradictory to each other, but have common objects and common technical problems. The unison of the two methods will be an optimum production system. This system has already reached in part a level of the actual production for low-grade hot coils, but has faced difficulties for medium- and high-grade hot coils and other steel materials (such as angles, flat bars, bars and wire rods.)

Two typical and important technical problems relating to achievement of direct coupling and near-net-shaping will be described below. The problems incidental to the actual operation are not of course limited thereto, but those two problems are at least to be settled before.

1. Upstream and downstream lines should have almost the same production efficiency.

In a conventional c.c. process, particularly in a curved type c.c. process with which a strand is drawn right below from a mold and then further drawn while being curved, the casting efficiency per strand is about a half or a quarter of the efficiency of succeeding rolling even for billets, blooms and slabs. Therefore, simple mechanical coupling between the upstream c.c. line and the downstream rolling line is very inefficient. Alternatively, if hot billets, blooms and slabs are immediately transferred to be rolled from multi-strand c.c., the efficiency would be balanced, but the direct coupling effect would be greatly sacrificed.

On the other hand, it has been attempted to increase the crossection area of a strand or the metallurgical length for the purpose of improving the efficiency of c.c. However, the former case necessarily requires a break-down rolling step, making direct coupling naturally unable to achieve, and hence is contrary to the tendency toward the near-net-shaping. The latter case has succeeded in considerably increasing the efficiency for slabs and blooms. However, the rolling efficiency is still two or three times higher than the efficiency of c.c., meaning that it is essentially impossible to achieve direct coupling.

Thus, there is a great demand on drastically increasing the efficiency of c.c. and realizing a relatively medium- or small-scaled rolling train which is competitive as to the cost, i.e., improving the cost performance of a rolling train. For steel sheets, this problem has recently been solved through thin slab c.c. and strip casting. But the solution is still limited to low-grade steel sheets because of the problem of quality described below.

2. Quality should be almost the same level as in the prior art.

In existing production systems, the c.c. line and the rolling line are operated independently of each other under separate quality control so that the quality suitable for objective products is surely obtained. Further, surface quality and internal quality are both improved by adding such intermediate steps as break-down rolling, billet conditioning and reheating. Accordingly, if c.c. with small strand section is directly coupled to rolling, those intermediate steps would be omitted with a resultant reduction in quality. An attempt of applying the casting/rolling through system, which has been practiced for Al or Cu, to steel, is reported in "Wire Journal International", June 1989, P. 96. However, the products manufactured by that system are far from satisfying today's quality level of bars and rods in points of, e.g., surface defect, internal crack and center segregation. Hence that system is not widely practiced in the field.

Combination of direct coupling and near-net-shaping has been fairly progressed for steel sheets, but there still remains a critical problem in terms of quality as follows.

Thin Slab c.c. . . . CSP (Compact Strip Production) Process

As described in Reference (1) "SEAISI", Jan. 1990, P. 38, this process comprises c.c. of thin slabs being about 50 mm thick and continuous rolling into steel sheets being about 3 mm thick, directly coupled to each other. In this process, the mold section has a very narrow space as small as about 50 mm in the direction of short width. This raises many difficulties in operation and quality. Specifically, a combination of a submerged nozzle and powder casting is applied to a mold from the necessity of ensuring quality. To this end, this process requires a funnel-type mold having such a peculiar shape as that only a submerged portion has a wide width, to provide a space for setting the submerged nozzle therein. Using such a mold accompanies problems that the thin solidified shell is subject to undue forces and is more likely to cause longitudinal cracks or transverse cracks, and that the strand thickness is too thin to perform smooth powder casting.

Also, as described in the above Reference (1), a thin strand under solidification has a very large temperature gradient from the surface to the center of the strand. This is advantageous in producing finer grains and reducing segregation, butit raises a problem common to thin slabs c.c., i.e., a drawback of making the strand more easily susceptible to surface cracks or internal cracks. Moreover, center segregation is naturally caused because of formation of the solidification terminating point that is regarded to be inevitable in the casting process. As a result, products manufactured by this process are limited to relatively low-grade ones.

Thin Slab c.c. . . . ISP (In-line Standard Pressing) Process

As described in Reference (2) "SEAISI", Jan. 1990, P. 23, this process includes a pressing roll associated with c.c. of thin slabs being about 50 to 100 mm thick, so that a not-solidified strand or a strand after solidification is drafted into a thinner strand. As with the Reference (1), a combination of a submerged nozzle and powder casting is applied to a mold. While the problem of the mold in the above process is solved in this process by using a mold being rectangular in section and a flat nozzle, the above-mentioned disadvantages common to all thin slabs are all present. Additionally, press rolling a drafting a not-solidified strand raises a problem of cracking and increases a risk of peculiar segregation due to the cracking, resulting in difficulties in quality control. The drafting after solidification only means that a rolling mill is positioned on the more upstream side, and hence it cannot be said as an essential effect for providing thinner slabs.

Strip c.c. Process

This process is to cast a steel sheet or a steel sheet blank, which is about several mm thick, directly from molten steel. Specifically, molten steel is dropped onto the surface of a single rotating roll so that it is quenched to be momentarily solidified on the roll surface, or molten steel is cast between two rolls facing each other so that it is momentarily solidified, followed by welding the opposite solidified surfaces between the two rolls under pressure to form a strand being several mm thick and (1000 to 2000) mm wide. The production line is very compact, has a reduced weight, and enables a quite remarkable reduction in the equipment cost because of no need of a heating furnace and many parts of expensive rolling trains. The operating cost is also cut down to a large extent correspondingly. However, since a cast steel sheet is formed by being momentarily solidified in this process, many problems of quality which are extremely difficult to solve are encountered in that surface defects such as wrinkles, slag patches, heat stress cracks and cast-gaps are more likely to occur, and that small fluctuations in a heat flow rate toward the mold surface immediately affect the solidified shell thickness and the internal stress, causing internal defects. Further, this process cannot provide a large forging ratio because of the thickness of the strand being too small. For these reasons, this process is not practically applicable to high-grade steel sheets, and has been developed for production of low-grade and stainless steel sheets, with resultant practical use in a very limited field.

Cored Strand Welding Process

Japanese Patent Laid-Open No. 57-97843 proposes a method of directly coupling a c.c. process free from center segregation and hot rolling. In this method, a curved strand pass line is elevated above the casting plane to define a cavity under vacuum with a non-solidified portion inside the strand removed back to a mold, and the cored strand is rolled into a solid strand. As a result, according to the description, it is possible to eliminate center segregation, control the strand thickness, and manufacture thin slabs. In terms of quality, however, such defects as semimacro segregation, porosity and V-segregation, which are extensively distributed around the core, cannot be solved. As to production efficiency, there is no suggestion about whether the casting efficiency is lowered due to a reduction in the effective sectional area or, on the contrary, increased for some reason or by using some means. Therefore, it is not clear that the proposed method is adaptable for coupling of continuous casting and rolling, or the promotion of near-net-shaping.

As described above, there are many problems in direct coupling of c.c., represented by the thin slab c.c. process, and rolling, as well as the near-net-shaping process. However, if those problems are solved and an optimum system is applied to production of not only strips, but also plates, including large-and small-diameter bars, flat bars, angles and rods, the resultant advantage is quite valuable. Specific problems to realize such an optimum system are in drastically increasing the casting efficiency without enlarging the sectional area of a strand or th e -metallurgical length in c.c., eliminating casting defects in the center, interior or surface, and reducing the sectional area of a strand as small as possible, i.e., further promoting near-net-shaping, to simplify the rolling mills and improve the ratio of equipment cost to performance.

BRIEF SUMMARY OF THE INVENTION

The present invention has been accomplished in view of the above-described state of art, and its main object is to provide a c.c. process which can offer the following advantages by improving a conventional curved type c.c. process:

[1] the casting efficiency is drastically increased,

[12] good surface quality and homogeneous internal structure are obtained, and core defects are eliminated, and

[31] strands of any desired thickness and shape are easily obtained.

The foregoing and following descriptions are made primarily in connection with an improvement in the curved type c.c. process, and a horizontal type c.c. process can also be improved by utilizing the principles of the present invention.

Another object is to efficiently couple the improved c.c. process and succeeding hot rolling, thereby providing a method of producing hot-rolled products such as hot coils, bars, flat bars, angles and rods in a through process from a casting stage.

A description will now be made of the feature of the present invention with which the above problems could be solved.

(1) An improvement in the c.c. process will first be described.

The basic feature of the c.c. process according to the present. invention is in that a molten core inside a strand is stalled at a specific point Q in a strand pass to form a cored portion including no molten steel (hereinafter referred to as cored portion) in the strand downstream of the specific point Q, and the cored portion is welded by a pair of rolls under pressing to draw the cored strand as a solid strand.

Particularly, the typical aspect of the present invention is in that curved type c.c. of steel is performed such that the strand pass is curved at least immediately after the strand is cast out of a mold, the length of a curved portion of the strand pass is set to be ¾ or more of the circumference of a circle, the strand is drawn up to a position above a casting plane, which is meniscus level in the mold the position higher than the casting plane by a height of the ferrostatic pressure corresponding to the atmospheric pressure is set as the specific point Q, and solidified shell thickness ratios $\alpha$, $\alpha'$ at the specific point Q determined from the following equations are set to be in the range of 0.25 to 0.85;

solidified shell thickness ratio when the strand has a circular cross section $a=2d/D$, and solidified shell thickness ratio when the strand has a rectangular cross section $\alpha'=2d/A$ where d: solidified shell thickness (m) of the strand, D: diameter (m) of a mold cross section when the mold has a circular cross section, and A: short width (m) of a mold cross section when the mold has a rectangular cross section.

A casting temperature is selected to be, higher than the liquidus temperature of the steel grade of interest, [1] in the range of 20° to 60° C. so that the region inwardly of a chill crystal in a strand skin being several mm thick becomes essentially a columnar crystal, or (2) in the range of 0° to 15° C. so that the region inwardly of a chill crystal in a strand skin being several mm thick becomes essentially a equi-axised crystal by applying electromagnetic stirring to molten steel in the mold.

The cross section of the strand is circular or rectangular in shape. When the strand has a circular cross section, a preferred aspect of the invention is in that equipment specifications and casting conditions are set in accordance with the following equations (1) to (4) so that the solidified shell thickness ratio $\alpha$ at the specific point Q is in the range of 0.4 to 0.85 ;

$$Pn=\pi\rho k^2\cdot Ln[2/\alpha)-1] \quad (1)$$

$$V=(4k^2/\alpha^2)\cdot(Ln/D^2) \quad (2)$$

$$R=(Ln-1.4)/\pi \quad (3)$$

$$\alpha=2d/D \quad (4)$$

where Pn: casting efficiency (kg/min),

ρ: steel density (7600 kg/m$^3$)

Ln: metallurgical corresponding to the length (length between the casting plane and the specific point Q: m), D: diameter (m) of the mold cross section, d: solidified shell thickness (m) of the strand, k: solidification constant 0.023 to 0.031 (m/min$^{0.5}$ ), R: radius (m) of curved portion of the strand pass and V: strand casting speed (m/min).

When the strand has a rectangular cross section, it is preferable that equipment specifications and casting conditions be set in accordance with the following equations (5) to (11):

$$Pn=4k^2\rho\cdot(\pi R+1.4)\cdot[(1/\alpha)+(\beta/\alpha)-1] \quad (5)$$

$$V=(\pi R+1.4)\cdot(2k/\alpha A)^2 \quad (6)$$

$$P=(2d-A')/2d \quad (7)$$

$$d=k\cdot(\pi R+1.4)^{0.5} \quad (8)$$

$$A'=2(1-p)\cdot d \quad (9)$$

$$\alpha'=2\ d/A \quad (10)$$

$$\beta=B/A \quad (11)$$

where A: short width (m) of the mold cross section,

B: long width (m) of the mold cross section,

α': solidified shell thickness ratio when the strand has a rectangular cross section, β: aspect ratio, A': short width thickness (m) of the solid strand cross section, and p : effective rolling reduction by pressing rolls In the case of manufacturing high-grade steel sheets ranging from thin slabs to thick slabs when the strand has a rectangular cross section, preferable conditions are as follows. The short width A of the mold cross section is in the range of 0.100 to 0.300 m, the solidified shell thickness d of the strand immediately before the pressing is in the range of 0.025 to 0.120 m, and the strand is pressed over the entire long width of its section in the direction of the short width thereof so that the short width thickness A' of the solid strand cross section is in the range of 0.035 to 0.200 m. On the other hand, in the case of manufacturing universal steel sheets for general uses, preferable conditions are as follows. The short width A of the mold cross section is in the range of 0.100 to 0.140 m, the solidified shell thickness d of the strand at the specific point Q is in the range of 0.010 to 0.020 m, the shell thickness d is set in accordance with the following equation (12) so that the short width thickness A' of the solid strand cross section is in the range of 0.012 to 0.030 m, and the effective rolling reduction p by pressing rolls is in the range of 0.05 to 0.4 ;

$$d=k\cdot(\pi R'/2V)^{0.5} \quad (12)$$

where R': radius (m) of curved portion of the strand pass

As a method of progressing near-net-shaping of a beam blank, in connection with pressing of the strand to weld the cored portion therein, it is recommended to press the strand by rolls with caliber or by a universal mill so that the transverse section of the solid strand is deformed into an I- or H-shape.

Means for shortening the metallurgical length to make the solidified shell thickness smaller is not limited to the method wherein the length of the curved portion of the strand pass line is set to be ½ or more of the circumference of a circle, and the strand is drawn up to the position above the casting plane. An alternative method may also be employed in which the length of the curved portion of the strand pass line is set to be ¼ or more of the circumference of a circle with the lowermost point of the arc set as the specific point Q, the strand is drawn up to a position above the specific point Q while holding a tip end position of the molten core inside the strand in the vicinity of the specific point Q, and an inert gas is filled under pressure into the strand downstream of the specific point Q to form the cored portion. In this case, solidified shell thickness ratios α,α' resulted after forming the cored portion are desirably set to be in the range of 0.05 to 0.5.

The mold for use in the c.c. process of the present invention is not limited to a particular one. From the standpoints of increasing productivity and thinning the solidified shell thickness, however, the mold is especially preferably constructed such that three faces of the mold are defined by a rectangular-sectioned groove built along an outer circumferential surface of a water-cooled wheel rotatable in a vertical plane, and the remaining one face of the mold is defined by placing an endless belt in close contact relation so as to close the zone of the groove in which the strand is being solidified, the mold being driven in synch with drawing of the strand.

(2) Next, the feature of the present invention for directly coupling the above c.c. process to a rolling process is as follows.

The basic feature of the continuous casting/rolling process is in that the solid strand in a red-hot state produced by the above c.c. process is supplied to a single-strand rolling as a continuous strand as it is, after being evenly heated through an equalizing furnace or directly without passing the equalizing furnace, so that the strand is rolled into a hot coil, an angle, a flat bar, a bar, a wire rod, etc.

Also, a rolled material may be cut into two or more parts parallel to the running direction between rough rolling and finish rolling, the cut parts being supplied to separate finish rolling pass to be rolled into products.

Particularly when a wire rod is manufactured, the weight of a single rod coil is selected to be in the range of 3 to 20tons.

BRIEF DESCRIPTION OF THE DRAWINGS

The construction, operation and advantages of the present invention will hereinafter be described in detail with reference to embodiments and drawings in which:

FIGS. 4(*a*), 4(*b*) and 4(*c*) show an example of manufacturing a beam blank by press rolling the cored strand.

DETAILED DESCRIPTION OF THE INVENTION

Figure 1:
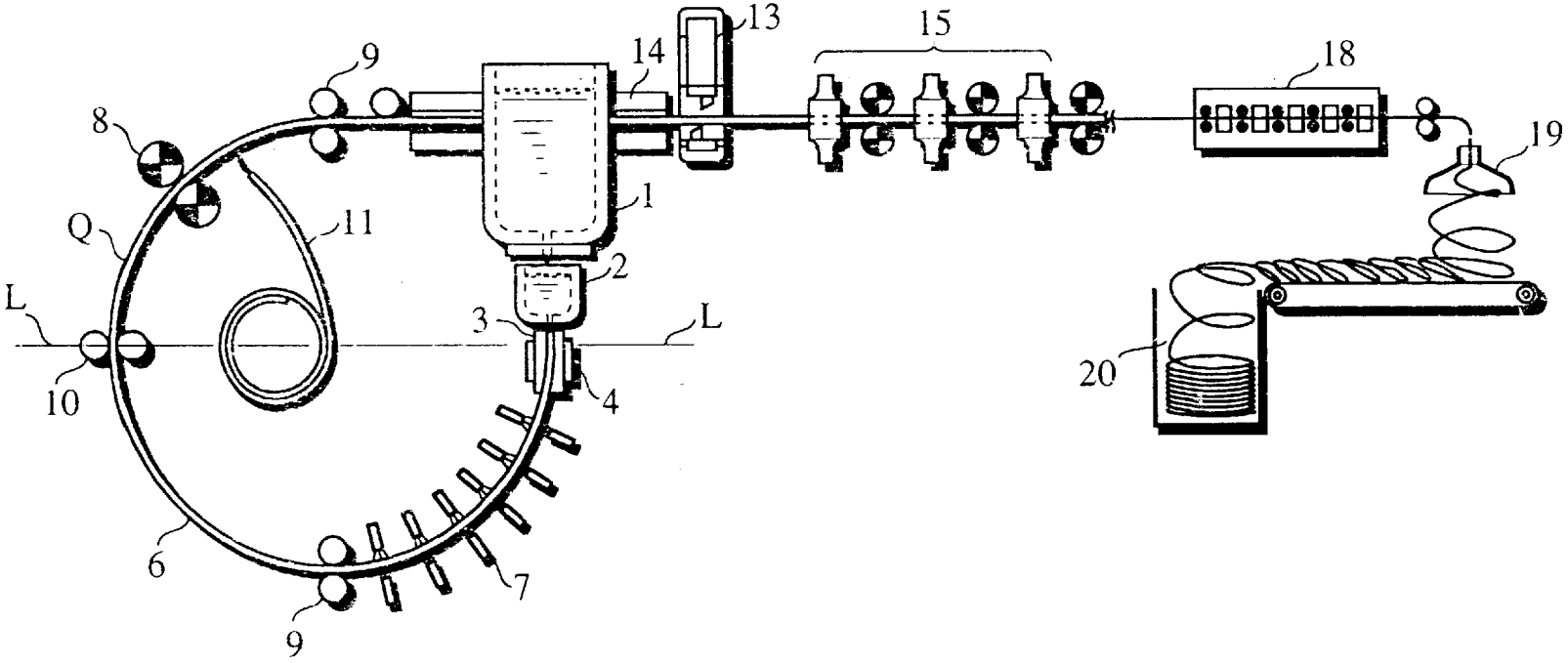
FIG. 1 is a schematic side view illustrating a c.c./continuous rolling equipment for used in the present invention.
Figure 2:
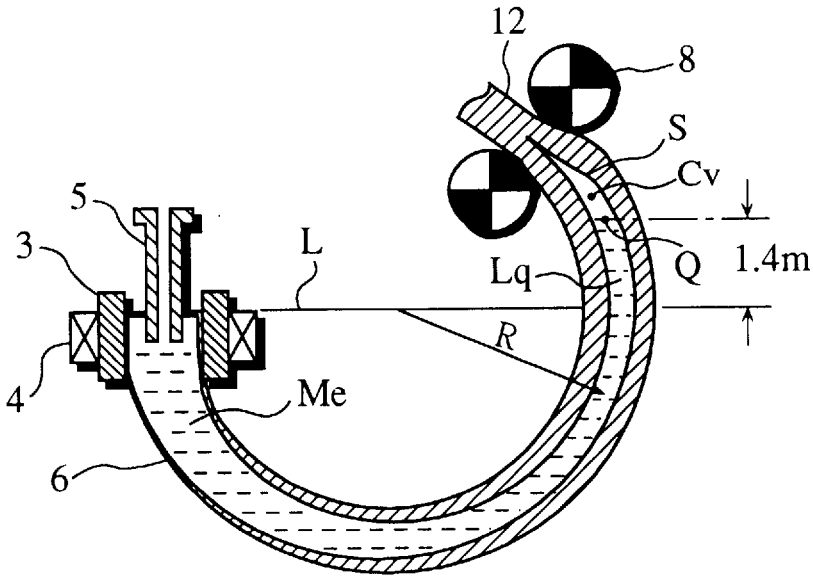
FIG. 2 is a schematic view for explaining press rolling of a cored strand as an essential of the present invention.

Based on the conventional curved type c.c. process as a basic model, an equipment for use in the present invention has the entire construction as shown in FIG. 1. FIG. 2 is an enlarged explanatory view of an essential part of FIG. 1. Molten steel Me is supplied from a ladle 1 through a tundish 2 to a mold 3 where it is cooled into a strand 6 while forming a solidified shell. The strand 6 is then drawn through pinch rolls 10 guide rolls 9 and spray unit 7. At this time, the front half of a pass of the strand 6 is set to have the form of an arc having a radius R, and the length of an arc-shaped portion of the strand pass is set to be ¾ or more of the circumference of a circle. Also, the strand 6 is drawn up to a position above a casting plane (i..e., a level of the molten steel in the mold) L. Specifically, as shown in the enlarged explanatory view of FIG. 2, the strand 6 is lifted up beyond a position (specific point in the present invention) Q that is located higher than said casting plane L by about 1.4 m (determined from the ferrostatic pressure corresponding to the atmospheric pressure). As a result, a molten core Lq exists inside the strand 6 until the position Q, but a cored portion S including no molten steel Me with a cavity Cv under vacuum defined therein is formed downstream of the position Q. The solidified shell thickness ratio at the specific point Q is set to any desired value in the range of 0.25 to 0.85.

Then, the cored portion S including no molten steel Me is welded by being rolled by a pair of pressing rolls 8 so that the cored strand is transformed into a solid strand 12. Subsequently, the solid strand 12 is sent to a tandem roughing train 15 through the guide rolls 9, an equalizing furnace 14 shear, etc. and then to a reel 19 through an intermediate train 16 and a finishing train 18. The reel 19 reels up the solid strand as a hot-rolled product which is then formed into a coil by a reforming tub 20. During the above process, the strand 6 is continuously rolled without being cut. It is desired that the strand be cut depending on the weight of a single product before reaching the reforming tub 20. In some cases, gas such as hydrogen may be released into the cavity Cv from an inner surface of the solidified shell, and a partial pressure of the gas in the cavity Cv may be increased to lower the point Q. Even in such a case, the partial pressure and the content of hydrogen as solid solution are balanced in time according to the Sievert's Law and, thereafter, the gas release is stopped and the steady casting state is established with the point Q lowered a little.

The foregoing is a description of, in connection with one embodiment, the concept of the present method featured in that, in c.c. of steel, the molten core inside the strand is expelled at the specific point Q toward the upstream side in the strand pass to form the cored portion downstream of the specific point Q, and the cored portion is rolled under pressing to draw the cored strand as the solid strand. The present invention can be embodied in various ways for practical use as described later. In a horizontal type c.c. process, for example, by drawing a strand upward slightly obliquely, the tip end of a molten core of the strand is stalled at the position (i.e., the point Q) about 1.4 m higher than the level of molten steel in a mold, creating a cored portion downstream of the point Q as with the above case. Therefore, the cored portion can be welded by a pair of pressing rolls in a similar manner.

The present c.c. process provides various advantages in addition to the following three:

(1) improvement in casting efficiency, (2) elimination of core defects, and (3) manufacture of thin strand.

Review on Casting Efficiency:

The theoretical casting efficiency Po (kg/min) for a strand to completely solidify according to the prior art is determined from the following equation (13) when the strand has a square section with each side of Ds (m):

$$Po=\rho\times Ds^2\times V \tag{13}$$

[ρ: steel density (kg/m$^3$), V : casting speed (m/min)]

The progress of solidification is expressed by the following solidification approximate equation (14) that is well known in the art:

$$d=k\times t^{0.5} \tag{14}$$

[d: solidified shell thickness (m), k: solidification constant (m/min$^{0.5}$), t: time (min)]

The metallurgical length L, i.e., the length of a solidification zone, is given by the following equation (15):

$$L=V\times to \tag{15}$$

Atd=Ds/2t=to (min), where to is the time for the strand to totally solidify. From the equations (14) and (15), therefore, the following equation (16) is given by:

$$Ds^2V=4k^2L \tag{16}$$

By substituting equation (16) into the equation (13)

$$Po=4\rho k^2L \tag{17}$$

is resulted.

The theoretical casting efficiency Po' when the strand section is rectangular and the casting efficiency Po" when the strand section is circular are expressed respectively by the following equations (18) and (19):

$$Po'=4\rho k^2\beta L \tag{18}$$

$$Po''=\pi\rho k^2L \tag{19}$$

[β: aspect ratio=long width / short width]

Thus, the casting efficiency is independent on the strand size and is proportional to only the square of the solidification constant k depending on the rate of cooling and the metallurgical length L. In the actual operation, the casting efficiency is 60 to 80% of the calculated values by the above equation at maximum due to restrictions in points of quality and field work, and the number of strands required is determined based on the effective efficiency.

If the metallurgical length L is increased to improve the efficiency, the problems of quality, field work, equipment cost, etc. would be further magnified with an increase in the casting speed V.

In contrast, the casting efficiency Pn in the present invention is expressed by the following equations (20) and (21) with the solidification shell thickness ratio α (=2d/D), α' (=2d/A) as a parameter:

rectangular section $$Pn=4\rho k^2 Ln(1/\alpha'+\beta/\alpha'-1) \quad (20)$$

circular section $$Pn=\pi\rho k^2 Ln(2/\alpha-1) \quad (21)$$

The equation (20) (21) are easily derived by using $Ds^2[1-(1-\alpha)^2]$ in the equation (13) instead of $Ds^2$ which means the area of the cross section, and by using $d=\alpha D/2$ in the equation (15) (16) instead of $d=Ds/2$.

The metallurgical length Ln in the present invention corresponds with the distance from the casting point to the point Q. Comparing the prior art and the present invention on condition of the same metallurgical length (i.e., Ln=L), the equations (17) and (20) are rearranged together into the following equation (22):

$$Pn=Po[(2/\alpha)-1] \quad (22)$$

Accordingly, when $\alpha=0.5$ is set in the present invention, the casting efficiency Pn is three times as much as that in the prior art. As will be seen from the equation (14), too, this result is attributable to the fact that the solidifying efficiency is very high in the initial stage of solidification, whereas it is extremely small in the latter half of the metallurgical length. Additionally, the efficiency improving effect resulting from selecting the rectangular section can also be provided as with the prior art. Thus, the weld rolling method of the strand's cored portion according to the present invention can drastically increase the casting efficiency.

Next, respective basic characteristics of the casting machine and the casting conditions will be described, including the relationship therebetween.

In the case of the circular section, as described above, the casting efficiency is:

$$Pn=\pi\rho k^2 Ln(2/\alpha-1) \quad (1)$$

From the equations (23) and (24), the casting speed is determined as given by the equation (2):

$$V=Ln/tn \quad (23)$$

$$dn=k\cdot tn^{0.5}=\alpha D/2 \quad (24)$$

$$V=(4k^2/\alpha^2)\cdot(Ln/D^2) \quad (2)$$

[tn: time (min) at which the strand reaches the specific point Q, dn: shell thickness (m) at Q, V, Ln and D: defined as above]

The radius R of the curved portion of the strand pass is naturally given by the equation (3):

$$R=(Ln-1.4)/\pi \quad (3)$$

When putting the present invention into practice, a preferable important requirement is to set c.c. conditions so as to satisfy the relationships of the three equations (1), (2) and (3).

Furthermore, if the solidified shell thickness ratio $\alpha(=2d/D)$ for the circular cross section is too small in practicing the present invention, rolled billets and blooms would become so flat as not to be suitable for bars and rods, and the casting speed would become excessively large. Therefore, $\alpha$ is preferably not less than 0.4. On the contrary, if $\alpha$ is too large, the process would be close to the prior art, meaning that the advantages of the present invention in terms of efficiency and quality of casting products would be less effective. Therefore, a is preferably not greater than 0.85. By setting the various parameters so that the casting efficiency Pn is in the range of 25 to 70 (ton/hour) while $\alpha$ is kept in the above range, direct coupling to rolling of bars and rods can be smoothly and economically carried out.

Also, when the strand section is rectangular, the parameters are calculated in a similar manner as above. Thus, the casting efficiency Pn, the casting speed V, the effective rolling reduction p the shell thickness d, and the solid strand thickness A' the solidified shell thickness ratio $\alpha'$ and the aspect ratio $\beta$ are expressed respectively by the equations (5), (6), (7), (8), (9), (10) and (11).

The solidified shell thickness ratio $\alpha'$ is desirably in the range of 0.25 to 0.85 so as to be adaptable for steel materials of various thicknesses unlike the above case of the circular section. The effective rolling reduction p is set to be in the range of 0.05 to 0.40 that is employed in ordinary weld rolling.

As described above, the first advantage of the present invention is a drastic increase in the casting efficiency.

However, the increased casting efficiency naturally increases the casting speed, which may cause a deterioration of quality due to core defects or internal cracks, and further operational troubles such as break-out. These problems are solved by the second advantage described below.

The second advantage, i.e., quality improvement such as elimination of core defects, will now be described.

In steel casting, the casting structure is made up such that a skin portion (usually on the order of several mm) ranging from the surface toward the center is quenched to form a dense and homogeneous chill crystal, a more inner portion ranging from several mm to several tens mm comprises a columnar crystal which is homogeneous in itself, and an innermost portion comprises a free-axised crystal. In the vicinity-of the core, there occurs casting defects, such as semimacro segregation and macro or micro shrinkage cavities, between equi-axised crystals. At the center, there occurs not only a center shrinkage cavity, but also center segregation that is inevitable due to the relative distribution ratios of the solute into the solid and liquid phases.

To eliminate those internal defects, the conventional c.c. process has taken such a measure as increasing the amount of equi-axised crystals and reducing the crystal size by low temperature casting and electromagnetic stirring so as to disperse the defects, or expelling out segregation by a liquid core reduction. However, any measure is not satisfactory and, in particular, semimacro segregation, porosity around the core, etc. are not improved.

When the excellently homogeneous casting structure is desired, the uni-axis solidified ingot process ("Bulletin of Japan Metal Society", 24, 4(1985), P. 304) or the ESR (Electroslag Remelting) process has been employed rather than c.c..

According to the present invention, the homogeneous structure comparable to the ESR process is obtained by c.c. More specifically, the structure of a c.c. product produced by the present invention essentially comprises a chill crystal, a columnar crystal and a equi-axised crystal developed in the innermost region depending on cases, as with the structure produced by the conventional c.c. However, because the solidified shell thickness ratio is properly set, the molten core is separated before reaching a state where semimacro segregation, macro or micro shrinkage cavities, etc. are developed between equi-axised crystals in the region around the core. After that, the solidification fronts are welded together under pressing. Accordingly, there is no possibility of generating core defects. In addition, by setting an optimum casting temperature, the advantage of the present invention of eliminating internal defects is further enhanced.

In other words, if the casting temperature is set to a relatively high value corresponding to the strand size, the dense and homogeneous structure essentially comprising only-chill crystals and columnar crystals is obtained without development of equi-axised crystals, the resulting structure being comparable to that of the uni-axis solidified ingot.

In general slab c.c., columnar crystals can be relatively easily developed until the center by increasing the casting temperature. In this case, however, since the solidification fronts advancing from both the front and rear sides collide against each other, the molten steels concentrated with some solution existing on the opposite solid/liquid interfaces are gathered and hence center segregation is inevitably caused. Thus, the structure simply comprising only columnar crystals cannot provide a homogeneous steel material.

In practicing the present invention, when the molten steel on the solid/liquid interface is hard to separate depending on the steel grade, means for electromagnetically stirring the region near the specific point Q to some extent for dispersing the concentrated molten steel concentrated with some solutes into the molten core may be provided additionally.

Figure 3:
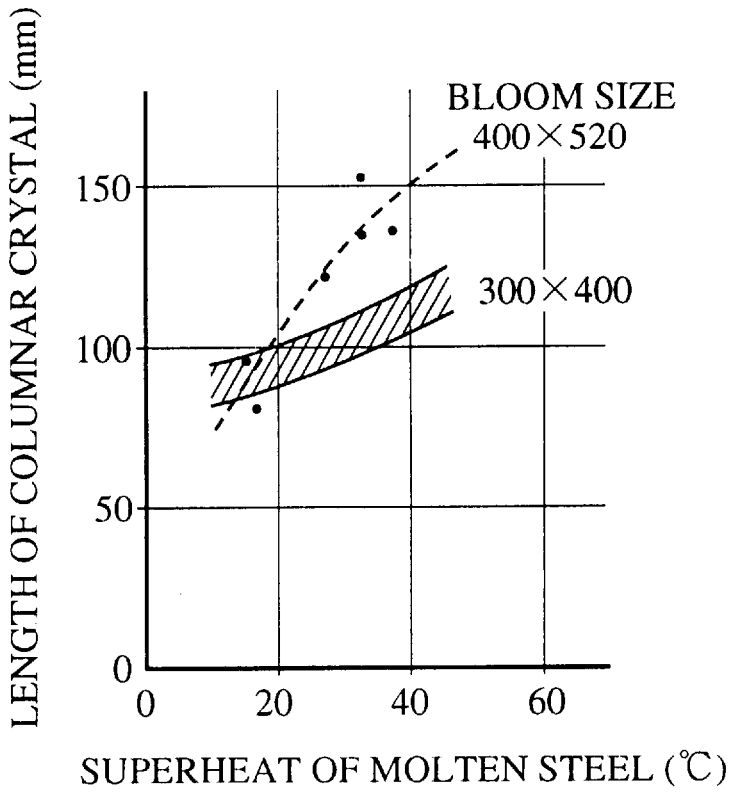
FIG. 3 is a graph showing an effect of casting temperatures upon the length of columnar crystal.

On the other hand, the growth of columnar crystals is more remarkable as the size of the strand section is increased, but not definitely determined because of dependency on the casting temperature as a primary factor and other causes. FIG. 3 is prepared to show an effect of the casting temperature (superheat) upon the growth of columnar crystals in the present invention, by way of example, corresponding to FIGS. 31 and 32 shown in Tate, "The 69th and 70th Nishiyama Memorial Lecture (by Iron & Steel Institute of Japan)", (1980) P. 171. It is seen from FIG. 3, when the superheat is changed from 20° C. to 50° C., the length of columnar crystal is increased from about 0.080 m to about 0.150 m. If electromagnetic stirring is applied, the length of columnar crystal is reduced on the contrary. In the present invention, therefore, a lower limit of the superheat is set to 20° C. for the strand having a small section so that the length of columnar crystal is at least 0.060 m. Likewise, an upper limit of the superheat is set to 60° C. for the strand having a large section so that the length of columnar crystal is at least 0.160 m. Note that because internal cracks and surface cracks due to thermal stress is more likely to occur with the increasing superheat, the superheat should be set to a temperature as low as allowable in the above range.

While the basic conditions for homogenizing the structure with columnar crystals has been described above, one example of applications of that effect is a reduction in the hot forging ratio required. Specific values cannot be quantitatively shown because of dependency on the manufacture processes, product kinds, uses and steel grades, but the strand section as small as in the allowable range is more cost effective. Guide lines of the casting conditions for each of objective products are as follows.

(1) Slab for Strip

Preferably, the strand has a rectangular section, and the various casting conditions are set so that the superheat is in the range of 20° to 40° C. and the solidified shell thickness at the point Q is in the range of 0.025 to 0.060 m. If the shell thickness is not less than 0.025 m. the curvature diameter of the strand would be so small as to raise difficulties in operation. If the shell thickness is not less than 0.065 m, excessive hot working would be required.

(2) Slab for Plate or Thick Plate

Preferably, the strand has a rectangular section, and the various casting conditions are set so that the superheat is in the range of 40° to 60° C. and the solidified shell thickness at the point Q is in the range of 0.060 to 0.120 m. If the shell thickness is not greater than 0.060 m, it would not suffice for thick plates. If the shell thickness is not less than 0.120 m, the plate section would be excessive.

(3) Billet

Preferably, the strand has a circular section, and the various casting conditions are set so that the superheat is in the range of 20 to 40° C. and the solidified shell thickness at the point Q is in the range of 0.030 to 0.080 m. If the shell thickness is not greater than 0.030 m, the casting efficiency would be too small. If the shell thickness is not less than 0.080 m, the cost would be too high.

(4) Bloom

Preferably, the strand has a circular section, and the various casting conditions are set so that the superheat is in the range of 40° to 60° C. and the solidified shell thickness at the point Q is in the range of 0.080 to 0.150 m. The shell thickness of 0.080 m is set as a lower limit because the forging ratio would be insufficient if not greater than 0.080 m. The shell thickness of 0.150 m is set as an upper limit because useless working would be generated if not less than 0.150 m.

In the cases of (3) and (4), the similar advantages are resulted even if the section shape is not circular but rectangular, but good quality can be more easily obtained for the circular shape. The reason is that, by applying an electromagnetic stirrer to the molten steel in the mold under the rotary magnetic field, the advantages of centrifugal casting are obtained in points of smoother surfaces, purging of pin holes and uniform solidification.

With the second advantage of the present invention, as described above, since the homogeneous casting structure free from core defects is obtained, it is possible to employ the present process in place of the uni-axis solidified ingot process or the ESR process depending on cases. Additionally, even when the hot forging ratio is insufficient for near-net-shaping, the homogeneous structure developed by the present invention can compensate for such a deficiency.

In some of stainless steel products or the like, the growth of columnar crystals is not desired, and the structure in which equi-axised crystals are prevailing is preferred. In such a case, low temperature casting (superheat 0° to 15° C.) and electro-magnetic stirring of the molten steel in the mold have been utilized as solution means. By properly selecting a value of the solidified shell thickness ratio a when those means are applied to the present invention, it is possible to suppress the occurrence of semimacro segregation, macro or micro shrinkage cavities, and V-segregation around the core which have been unavoidable in the prior art.

Relating to the problem of quality, the advantage of the present invention which is effective to cope with an increase in defects due to high-speed casting will be described below. A critical drawback of high-speed casting is in causing the strand to be easily susceptible to bulging of the strand. The bulging leads to internal cracks and may also cause breakout. In particular, when the strand section is large, it is very difficult to prevent the bulging from occurring.

In the present invention, the height of the machine is about ½ to ¼ of that required in the prior art owing to the features that the metallurgical length is remarkably small in principle and the strand is drawn upward. Accordingly, the ferrostatic pressure acting upon the solidified shell is reduced correspondingly and the bulging becomes less likely to occur.

Next, the third advantage, i.e., easier achievement of the near-net-shaping process, will be described below.

In the present invention, when the metallurgical length, depending on the radius of arc of the strand pass, is reduced as far as possible and the casting speed is maximally increased on condition that the shape and size of the strand section are set to be the same as in the conventional slab c.c., the shell thickness at the point Q is thinned correspondingly. In other words, thin slabs can be easily manufactured by simply changing the form of the strand pass in the conventional slab c.c. It is a matter of course that the techniques which are highly effective to improve the surface quality and have been established up to date, such as combination of a submerged nozzle 5, powder casting and an electromagnetic stirrer 4, can be applied directly. This is the reason why the short width of the strand section is set to be in the range of 0.100 to 0.300 m.

Many of the problems occurred relating to the mold with speed-up of casting have been or are being solved todays, and various problems in relation to the secondary cooling zone remain unsolved. In the present invention, however, since the metallurgical length and the height of the machine are both reduced to a large extent, the bulging can be very easily dealt with.

The quantitative relative equations among the solidified shell thickness d, the arc radius R, the casting speed V, the solid strand thickness A', etc. of resulting thin slabs have already been described. The reason why the minimum value of d is set to 0.025 m is basically that the smaller the shell thickness, the more economical will be the system. Another reason is that d becomes about 0.025 m on condition that the practical minimum value of R is 2 m, the maximum value of V is in the range of 5 to 6 m/min, and the minimum value of k is 0.023 $m/min^{0.5}$ . Therefore, d=0.025 m is set as a practically feasible lower limit.

As to A', its lower limit t is similarly set to 0.035 m on condition that the effective rolling reduction p by the pressing rolls is maximally 0.3.

Because thin slabs produced as described above have superior surface quality comparable to conventional slabs, they can be directly supplied to an intermediate train in succession and can be easily rolled into hot coils through simple equipment and simple steps, as with conventional immediate-feed rolling.

As shown in FIG. 4(*a*), a cored strand 22 being thin and having a rectangular tubular shape is cast. When welding the cored strand 22 under pressing to draw it as a solid strand, the solid strand is reformed in section into an I-shape 31 or an Hshape 33 by using a rolling mill 32 with caliber shown in FIG. 4(*b*) or by using a universal mill 34 shown in FIG. 4(*c*), respectively. This means that near-net-shaping is further advanced as compared with the conventional beam blank c.c. process. In addition, the product having superior quality in both the surface and internal regions can be easily obtained without encountering the problems of quality, such as surface cracks, internal cracks and segregation, due to peculiar shapes which have been unavoidable in the conventional beam blank c.c. process.

In the case of desiring to manufacture thinner slabs than described above, a new contrivance is required in practicing the present invention as follows.

To reduce the shell thickness, as will be seen from the equation (8), the solidification time is required to be minimized by minimizing the metallurgical length and maximizing the casting speed. To this end, it is recommended to set the specific point Q at the lowermost point in the arc of the strand pass line by utilizing a gas pressure. This method is outlined in FIG. 5. In this case, the shell thickness d is calculated by the equation (12).

The solidified shell thickness ratio is set to be in the range of 0.05 to 0.5 for the following reason. If the ratio is less than 0.05, the shell thickness would be as thin as 10 mm or below in the actual pass. As the shell thickness is easily uneven depending on the position the mold and time in such early stage of solidification, various defects are likely to occur due to uneven strain during press rolling. On the contrary, if the ratio is not less than 0.5, the shell thickness would be too large to achieve the intended object.

Figure 5:
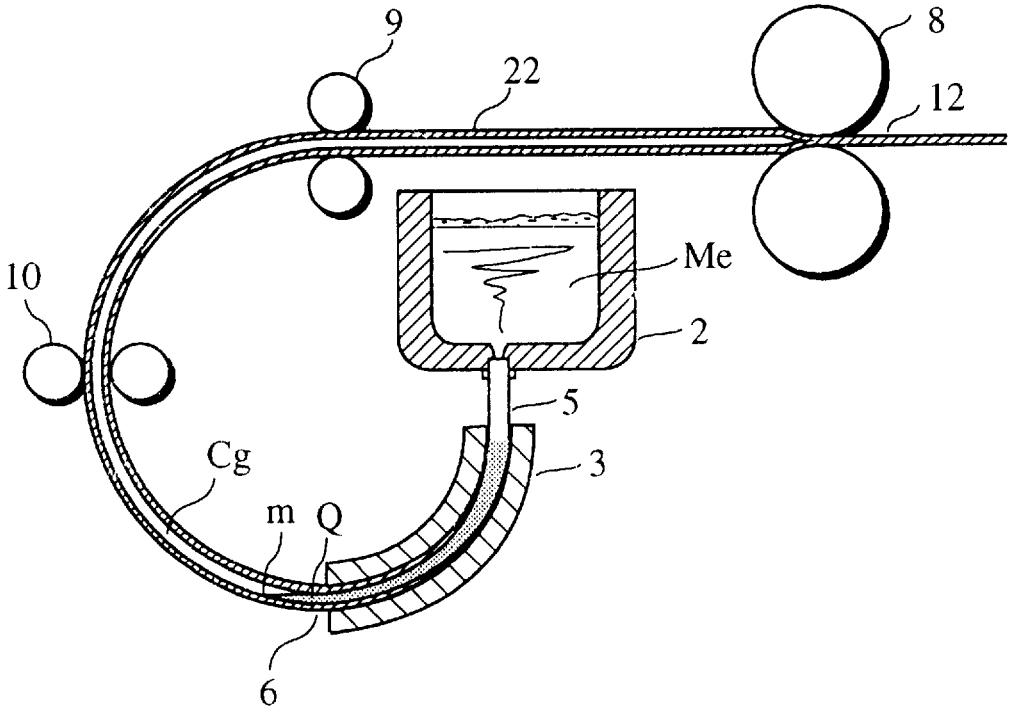
FIG. 5 shows an example of manufacturing the cored strand by filling with a gas.

The method shown in FIG. 5, i.e., the method of producing a cored strand filled with gas downstream of the specific point Q, will be described below with reference to FIGS. 7(*a*), 7(*b*) and 7(*c*).

Figure 7A:
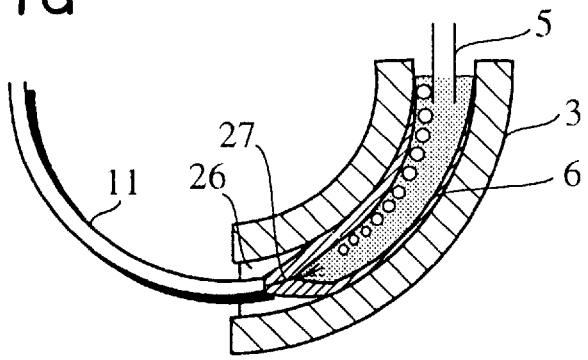
FIGS. 7(*a*), 7(*b*) and 7(*c*) show a method for forming a cored portion by filling a gas.
Figure 7B:
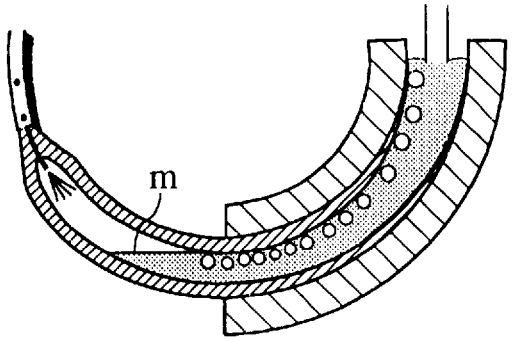
Figure 7C:
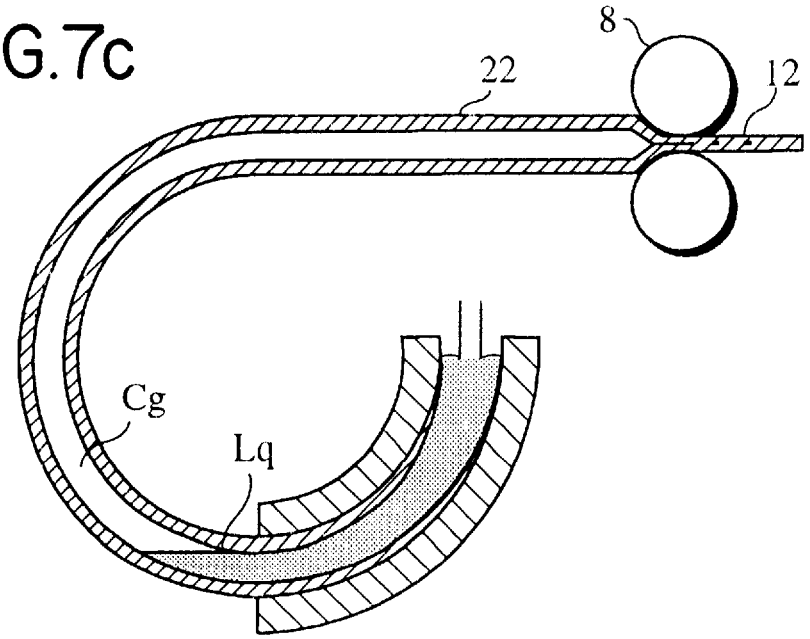

FIG. 7(*a*) shows the state at the start of casting. A lower opening of the mold is closed by a dummy bar 11 and a dummy bar head 26. The dummy bar 11 has a gas blow nozzle 27 which is in the form of a steel or ceramic pipe and is attached to its tip end. The casting is started and the dummy bar 11 is drawn while blowing an inert gas through the nozzle 27. At this time, there occurs bubbling, but this phenomenon gives rise to no troubles in operation.

When the nozzle passes over the lowermost point of the strand pass as shown in FIG. 7(*b*), the amount of gas blown is increased to such an extent that a cavity Cg is formed inside the strand and excessive gas is injected from the lowermost point Q into the molten steel, followed by moving reversely to the flow of the molten steel and floating up as bubbles therethrough. Simultaneously, a level m of the molten core is maintained to the upper solidification front of the strand at the lowermost point. Of course, solidification is not progressed in the downstream side of the level m. It will be easily understood that the point Q is moved to the upstream or downstream side under control of the gas pressure.

When the nozzle reaches the pressing rolls as shown in FIG. 7(*c*), the nozzle is rolled down with strand and the blowing of the gas is stopped. But the tip end of the strand is completely sealed off, leaving the gas in the cored portion there. As the inert gas is used, the sealed-off gas will not react with the molten steel and the solidified shell, and the initial gas pressure is maintained. Therefore, the level of the molten steel is kept near the lowermost point of the strand pass since then, resulting in a steady casting state.

If the curvature radius R is reduced, the bending strain acting upon inner surfaces of the strand which are still in the temperature range of brittleness would be so large as to cause internal cracks when the cored strand is drawn. Even in such a case, the molten steel concentrated with some solutes on the solid liquid interface will not enter the cracks unlike the molten core reduction process, resulting in no problem. This is another advantage of the present invention.

A practical method of maximizing the casting speed will now be described.

Figure 6:
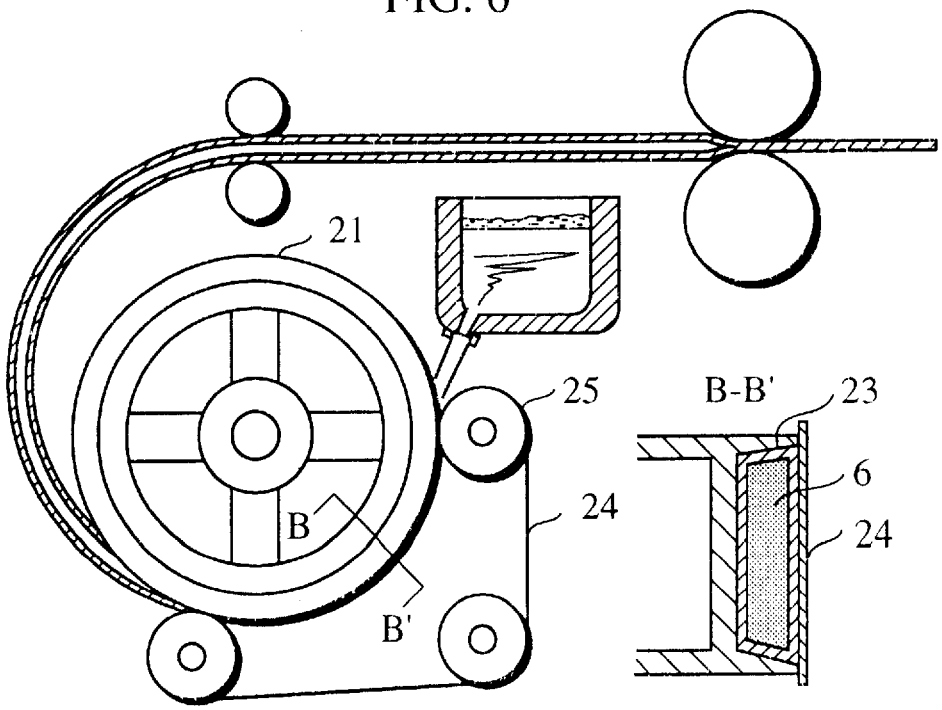
FIG. 6 shows an example in which the present invention is applied to rotary casting.

To this end, it is conceivable to propose the use of a synchronized vertically rotary mold in place of a general reciprocally vibrating curved mold. This is because as the radius R of the strand pass (=radius of the curved mold) is designed to become even smaller for reducing the shell thickness, it approaches the practical size of the synchronized rotary mold so that the replacement of the curved mold by the rotary mold is facilitated. This replacement enables the greatest advantage of the synchronized rotary mold, i.e., speed-up of casting, to be easily achieved. To describe the application method of the synchronized rotary mold, in FIG. 6 a rotary mold comprises a water cooled wheel 21, in groove 23 being rectangular in section and an endless belt 24, a turn roller 25 respectively for closing the groove. The molten steel is cast into the groove 23. The strand 6 is drawn while the circumferential speed is kept in match with the running speed of the belt.

In the process using the synchronized rotary mold, the casting speed on the order of about 10 m/min is already put into practice. In the present invention, therefore, the solidified shell thickness can be further reduced by gradually increasing the casting speed from 5 m/min.

While the three advantages of the present invention resulted from press rolling the strand in its cored portion, i.e., [1] improvement in casting efficiency, [2] elimination of core defects and homogenization of structure, and [3] easier near-netshaping, have been described above, the most important application of these features is in rationally coupling c.c. and rolling for various hot-rolled products.

The problem of the above application can be achieved very easily, rationally and economically based on the three advantages of the present invention, as described above. In addition to direct coupling between the upstream and downstream lines, the number of expensive rolling mills can be reduced by rendering the strand section as small as allowable in terms of quality. Thus, the present invention can provide both the achievement of line direct-coupling and the progress of near-net-shaping. The coupling of c.c. and rolling is carried out by once cutting the solid strand into billets, blooms or slabs and then supplying them to the rolling line in lots, or by directly supplying the solid strand to the rolling line in succession without cutting it. It is optional to evenly heat the solid strand by passing it through an equalizing furnace prior to rolling, or to supply the solid strand to the rolling line. Either method may be selected at need in consideration of actual situations about products and production.

By continuously rolling the solid strand, wire rod coils having large weight per coil, which has been difficult to manufacture in the prior art, can be easily manufactured. In the prior art, a rod coil of 3 tons at maximum was a practical limit because a large-weight billet and a large-scaled heating furnace were required and economics were badly ineffective. Because it is only required to enlarge the scale of a rod coil transport equipment in the present invention, a rod coil ranging from 3 to 20 tons can be easily manufactured at low cost. This is quite effective in rationalizing the secondary working process for wire rods.

Figure 8:
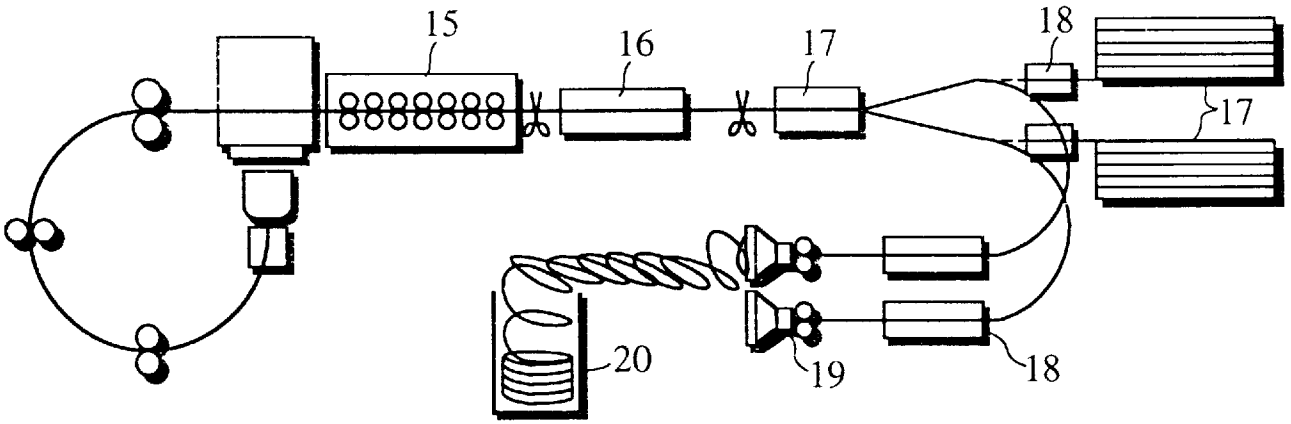
FIG. 8 shows an example of direct coupling between c.c. and rolling according to the present invention.

When manufacturing small-diameter rods and bars, a bottleneck in the production efficiency is a finishing speed. As a method of eliminating the bottleneck to increase the productivity, multi-line rolling has been employed in the past. Of late, a slit rolling process wherein a rolled material is slitted into two blanks parallel to the running direction prior to finish rolling and the two blanks are fed to separate or the same finishing train, is employed in some cases. Since the present invention is intended to, in principle, process the strand from c.c. to the product in a single-strand line, the slit rolling process can be applied as needed. FIG. 8 is a conceptual view showing such a case. In FIG. 8, denoted by 17 is a slitting roll. The combination with the slit rolling process effectively enhances the advantage of the present invention.

Table 1 summarizes basic specifications of the c.c. equipment when the present invention is applied to production of various hot-rolled steel materials. Based on values of the casting efficiency and the solid strand size in Table 1, those skilled in the art can easily and rationally design subsequent rolling trains.

TABLE 1

| Products | Plate | Strip | H-Beam | Bar | Rod |
|---|---|---|---|---|---|
| Casting efficiency (T/H) | 110 | 100 | 90 | 100 | 40 |
| Short width of mold transverse section (m) | 0.250 | 0.100 | 0.280 | 0.160 | 0.180 ϕ |
| Long width of mold transverse section (m) | 1.200 | 1.600 | 0.500 | 0.420 | |
| Aspect ratio | 4.8 | 16 | 1.7 | 2.6 | — |
| Solidified shell thickness ratio | 0.8 | 0.26 | 0.25 | 0.75 | 0.60 |
| Solidified shell thickness (m) | 0.100 | 0.013 | 0.035 | 0.060 | 0.054 |
| Casting temperature (superheat) (°C.) | 30–50 | 10–30 | 20–40 | 25–50 | 25–50 |
| Casting method (submerged nozzle + powder casting) | applied | applied | applied | applied | applied |
| Casting speed (m/min) | 1.0 | 5.0 | 4.0 | 4.0 | 4.1 |
| Solidification constant ($m/min^{0.5}$) | 0.025 | 0.025 | 0.025 | 0.031 | 0.030 |
| Metallurgical length (m) | 16 | 1.4 | 7.8 | 15.0 | 13.3 |
| Radius of casting pass line (m) | 4.6 | 0.9 | 2.1 | 4.3 | 3.8 |
| Effective draft ratio by pressing | 0.20 | 0.30 | 0.20 | 0.30 | 0.20 |
| Short width of solid strand (m) | 0.160 | 0.018 | 0.056 | 0.084 | 0.086 |
| Long width of solid strand (m) | 1.290 | 1.680 | | 0.430 | 0.210 |
| Product size (m) | 0.030 × 1.200 | 0.001 × 1.600 | 0.300 × 0.300 | 0.013 – 0.060 ϕ | 0.0055ϕ |

The present invention can provide the following many advantages by employing curved type c.c. in which a strand having a not-solidified portion remained therein is drawn upward in combination with high-temperature casting to become a cored strand where the region inwardly of chill crystals comprises columnar crystals entirely, and the cored strand is then welded under pressing to be further drawn as a solid strand, or by employing a successive through-process wherein the solid strand is immediately supplied to a rolling line.

(1) As expressed in the equation (1), the casting efficiency is drastically increased to a level comparable to the rolling efficiency of ordinary bars and rods. Therefore, c.c. and rolling can be directly coupled with a remarkable reduction in the equipment cost and the operating cost.

(2) Since the solidification terminating point is not present, there occurs no segregation. Also, since the internal region comprises only essentially homogeneous columnar crystals, the present invention is very advantageous in application to the field of high-grade steel.

(3) As another advantage based on (2), since the hot forging ratio can be reduced to enable an improvement in ductility and toughness of steel, the cross section of the strand required for casting can be reduced. On the contrary, rolled products having a larger area in section than in the prior art can also be produced. This results in a remarkable reduction in the equipment cost and the reduced production cost.

(4) As another advantage based on (2), rather than using the uni-axis solidified ingot process or the ESR process, homogeneous billets, blooms and slabs can be manufactured by c.c. at reduced cost and higher productivity.

(5) When the present invention is applied to low-grade, massproduced ordinary steel, impurity control can be moderated within the standards because of no segregation. This leads to a remarkable reduction in the iron scrap cost and the refining cost.

(6) For bars and rods, if [1] the strand section is set to be circular and [2] the centrifugal casting effect is added by applying electromagnetic stirring to molten steel in the mold under the rotary magnetic field, the product quality is highly improved as a result of suppression of bulging and prevention of internal cracks due to the lowered height of the machine, as well as uniform solidification, surface smoothing and purging of pin holes. An intermediate process between c.c. and rolling can be omitted with no problems.

(7) When the present invention is applied to slabs, resulting slabs have the surface quality comparable to that obtained by the conventional c.c. and the internal quality much improved, and they can be easily thinned. Additionally, very thin slabs can also be manufactured depending on setting conditions.

(8) As another advantage based on (7), not only the c.c. equipment is simplified, but also the rolling trains are further simplified. This means that the present invention provides a novel near-net-shaping process for steel sheets.

(9) When the present invention is applied to large-sized angles, thin and high-quality beam blanks can be easily manufactured.

(10) When the present invention is applied to wire rods, a rod coil having super-large weight can be easily manufactured.

What I claim:

1. A continuous casting process for steel, the process comprising the steps of:

stalling a molten core inside a strand at a specific point Q in a pass of said strand to form a cored portion including no moltan steel in said strand downstream of said specific point Q; and welding said cored portion by a pair of rolls under pressing said rolls drawing said cored strand solid strand through a curved continuous casting path such that the strand pass is curved immediately after said strand leaves a casting mold said curved portion of the strand pass being set to be ¼ or more of the circumference of a circle, said specific point Q being set by filling an inert gas into said cored portion beforehand and solidified shell thickness ratios $\alpha,\alpha'$ are set to be in the range of 0.05 to 0.5.

2. A continuous casting process according to claim 1, wherein said strand has a rectangular cross section, a short width A of the mold cross section is in the range of 0.100 to 0.140 m, the solidified shell thickness d of said strand at said specific point Q is in the range of 0.010 to 0.020 m, and said shell thickness d is set in accordance with the following equation (12) so that a short width thickness A' of the solid strand cross section is in the range of 0.012 to 0.30 m:

$$d=k\cdot(\pi R'/2V)^{0.5} \tag{12}$$

where R' : radius (m) of curved portion of the strand pass.

3. A continuous casting process according to claim 2, wherein three faces of said mold are defined by a rectangular-sectioned groove built along an outer circumferential surface of a water-cooled wheel rotatable in a vertical plane, and the remaining one face of said mold is defined by placing an endless belt in close contact relation so as to close a zone of said groove in which said strand is being solidified, said mold being driven in coordination with drawing of said strand.

4. A continuous casting/rolling process wherein the solid strand in a red-hot state produced by said continuous casting process according to claim 1 is supplied to a single-strand rolling pass as a, continuous strand after being evenly heated through an equalizing furnace, or directly without passing the equalizing furnace, so that said strand is rolled into a plate, hot coil, an angle, a flat bar, a bar, or a wire rod.

5. A continuous casting/rolling process according to claim 4, wherein a wire rod is manufactured and the weight of a single rod coil is in the range of 3 to 20 tons.

6. A continuous casting/rolling process according to claim 4, wherein a rolled material is cut into two or more parts in parallel to a running direction between rough rolling and finish rolling, said cut parts being supplied to a separate finish rolling pass to be rolled into products.

* * * * *